United States Patent [19]

Maybee

[11] 4,339,747

[45] Jul. 13, 1982

[54] BURGLAR ALARM

[76] Inventor: Richard C. Maybee, 2157 Deyncourt Dr., Burlington, Ontario L7R 1W2, Canada

[21] Appl. No.: 206,379

[22] Filed: Nov. 13, 1980

[30] Foreign Application Priority Data

Nov. 13, 1979 [CA] Canada ..... 339749

[51] Int. Cl.[3] ..... G08B 13/08

[52] U.S. Cl. ..... 340/547; 200/61.48; 200/61.52; 200/61.93; 335/207; 340/546

[58] Field of Search ..... 340/546, 547, 566, 571; 200/61.45 R, 61.39, 61.52, 61.93, 61.45 M, 61.48, 61.49; 335/205, 207

[56] References Cited

U.S. PATENT DOCUMENTS

| | | | |
|---|---|---|---|
| 3,364,318 | 1/1968 | Bulliet | 335/205 X |
| 3,548,400 | 12/1970 | Boyd et al. | 335/207 X |
| 3,725,892 | 4/1973 | Faltico | 200/61.93 X |
| 3,786,469 | 1/1974 | Massaro et al. | 200/61.52 X |
| 4,100,539 | 7/1978 | Stahl et al. | 340/546 |
| 4,227,188 | 10/1980 | Peterson | 340/546 X |
| 4,275,391 | 6/1981 | Okamura | 340/547 X |
| 4,282,518 | 8/1981 | Bonner | 340/546 X |

*Primary Examiner*—John W. Caldwell, Sr.
*Assistant Examiner*—Joseph E. Nowicki
*Attorney, Agent, or Firm*—Sim & McBurney

[57] ABSTRACT

There is provided an alarm, which includes a mounting base, and means for securing the mounting base to an item whose movement is to be signalled by the alarm. A magnetic reed switch constitutes a first element, and a magnet constitutes a second element. One of these elements is mounted on a pivotal member capable of pivoting with respect to the mounting base, while the other of the elements is capable of retaining a given position with respect to the mounting base. The relative distance from the pivot location for the pivotal member to the location of said other of said elements can be adjusted between a separated position in which the reed switch is unaffected by the magnet regardless of pivotal movement of the pivotal member, and a juxtaposed position in which the reed switch is (a) unaffected by the magnet when the pivotal member hangs initially in an equilibrium position, (b) closed by the magnet when the pivotal member swings through a given displacement from the equilibrium position, and (c) remains closed after the pivotal member swings back to the equilibrium position. An electrically-powered signal-creating device is provided, and an electrical circuit by which power from a power source is supplied by way of the reed switch to the signal-creating device.

7 Claims, 7 Drawing Figures

BURGLAR ALARM

This invention relates generally to burglar alarms adapted to be mounted on door knobs or on other structures of which the movement is to be signalled by the sounding of the alarm.

SUMMARY OF THE PRIOR ART

Two significant prior patents are U.S. Pat. No. 3,725,892, issued Apr. 3, 1973, to Faltico, and entitled "DOOR KNOB BURGLAR ALARM" and U.S. Pat. No. 4,012,731, issued Mar. 12, 1977, to Solomon, and entitled "BUGLAR ALARM SYSTEM".

The Faltico patent discloses a device adapted to be affixed to the knob of a door, so that as the door knob is turned, the device turns with it. Mounted in the device at a location spaced from the axis of rotation of the door knob are two mercury switches which are hooked up in parallel within a loop circuit connecting a battery with a sound-producing alarm. Any tilting of the device away from the "dead centre" position will cause the mercury in one or other of the mercury switches to close the loop circuit, thus sounding the alarm.

The Solomon system includes a stationary housing affixed not to the door handle but to the door itself, the housing having an opening through which the handle of the door projects. A lever arm is affixed to the shaft of the door handle and carries within it a magnet which naturally rotates as the door handle rotates. Within the housing is a loop circuit which includes a sound-producing horn, a battery, a main "arming" switch, and a reed switch. The reed switch is located close to the magnet, and is such that when the door handle is at rest, the magnet is close to the reed switch and the magnetic lines of force of the magnet are such as to keep the magnetic reed switch in the open position. Thus, no sound occurs. However, as soon as the door handle is turned, and the magnet moves through a given arc away from its "at rest" position, the shape of the flux lines changes, and this causes the magnetic reed switch to close, thus sounding the alarm.

The disadvantage of both these prior art constructions is that the alarm sounds only for the length of time during which the handle is turned away from its at rest position. Many people are very deep sleepers, and an alarm sounding for a very brief duration, however loud it may be, is sometimes insufficient to arouse them from their slumber.

In view of the aforementioned disadvantage, it is an aspect of this invention to provide a burglar alarm of extremely simple construction, which is such that the alarm does not stop when the door knob is released, thus ensuring that the sleeper is aroused.

SUMMARY OF THIS INVENTION

Accordingly, this invention provides an alarm comprising:

a mounting base, means for affixing the mounting base to an item whose movement is to be signalled by the alarm, a magnetic reed switch constituting a first element, a magnet constituting a second element, one of said elements being mounted on a pivotal member capable of pivoting with respect to the mounting base, the other of said elements being capable of retaining a given position with respect to the mounting base, means for adjusting the relative distance from the pivot location for the pivotal member to the location of said other of said elements, between a separated position in which the reed switch is unaffected by the magnet regardless of pivotal movement of the pivotal member, and a juxtaposed position in which the reed switch is (a) unaffected by the magnet when the pivotal member hangs initially in an equilibrium position, (b) closed by the magnet when the pivotal member swings through a given displacement from said equilibrium position, and (c) remains closed after the pivotal member swings back to said equilibrium position, an electrically-powered signal-creating device, and an electrical circuit by which power from a power source is supplied by way of said reed switch to said signal-creating device.

GENERAL DESCRIPTION OF THE DRAWINGS

Two embodiments of this invention are illustrated in the accompanying drawings, in which like numerals denote like parts throughout the several views, and in which.

Figure 1:
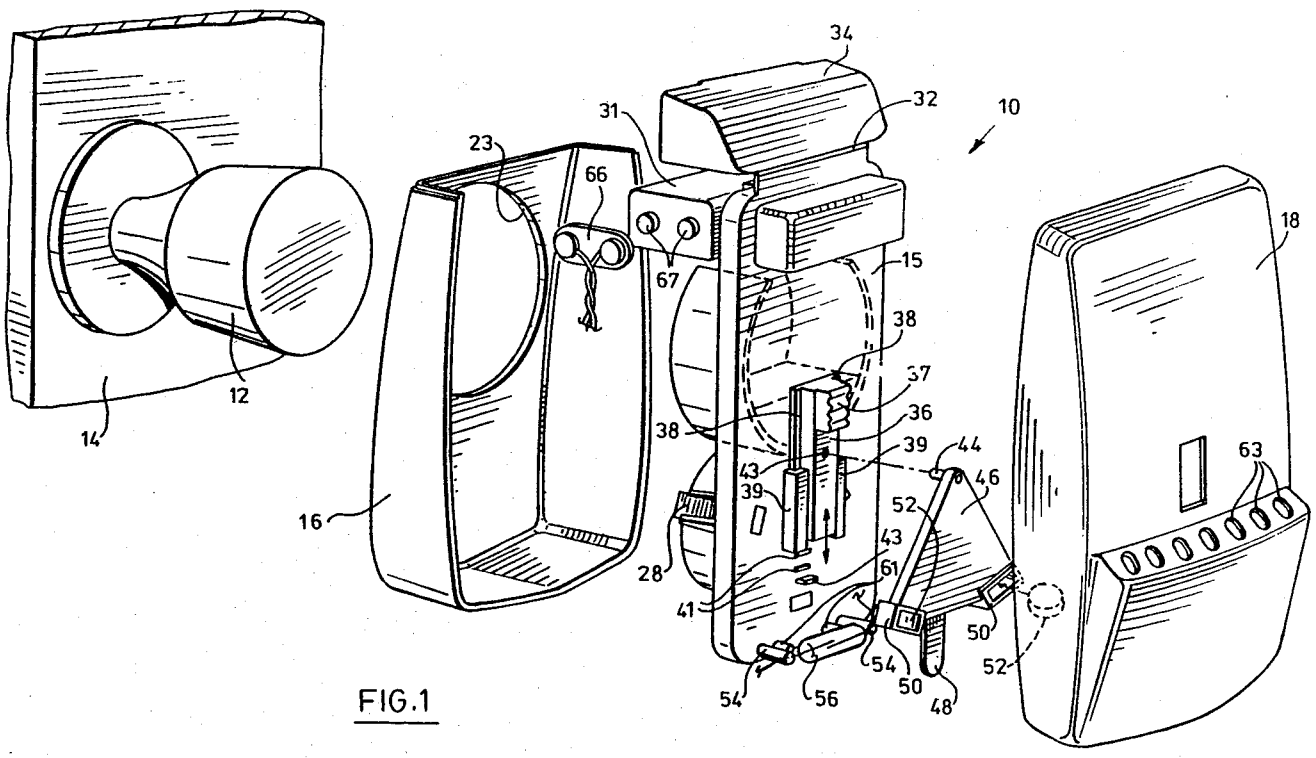
FIG. 1 is an exploded perspective view of an alarm according to the first embodiment of this invention.

Turning first to FIG. 1, there is illustrated generally an alarm 10 adapted to be affixed to a door knob 12 in a door 14. The alarm 10 includes a central mounting plate 15, a rear housing member 16 and a front housing member 18.

Figure 2:
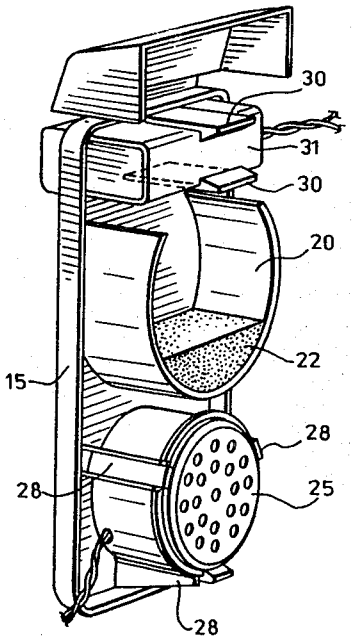
FIG. 2 is a perspective view of one component of the alarm of FIG. 1, seen from the other side.

Referring to FIGS. 1 and 2, the central mounting plate supports rearwardly a penannular clip member in the form of an incomplete short circular cylinder having a bottom segment filled with a resilient or foamy material 22. The clip member 20 and the filling of material 22 is sized to be able to accommodate the full range of typical door knobs, with the door knob pressing down into the material 22 and thus being resiliently but securely gripped thereby. As can be seen in FIG. 1, the rear housing member 16 has a circular aperture 23 in registry with the clip member 20, to allow a door knob 12 to enter and be engaged by the clip member 20.

Below the clip member 20 on the central mounting plate 15, mounted to the rear thereof, is a sound-producing alarm 25 which may be a standard off-the-shelf item, held in place by triangularly arranged clip arms 28.

Located above the clip member 20 are two further clip arms 30 extending in horizontal parallel relationship, these arms securing a standard 9-volt battery 31 between them.

Hinged to the top of the central mounting plate 15 through a "living" hinge 32 is a closure member 34 which is shaped to merge with the upper end of the rear housing member 16, and to enclose both ends of the battery 31, thereby protecting the same.

Referring now to FIG. 1, and looking specifically at the front side of the central mounting plate 15, there is provided a slide member 36 having an integral finger button 37 of corrugated outer surface, the slide member having rearward outward flanges 38 which are trapped within guides 39 formed integrally with the central mounting plate 15, whereby the slide member 36 is capable of sliding vertically to various locations. The engagement between the flanges 38 and the guide members 39 is a frictional one, thereby holding the slide member 36 in any position in which it is placed. To increase this frictional grip, small lateral ribs 41 can be integrally moulded into the front surface of the central mounting plate 15, over which the slide member 36 must move. Furthermore, a stop or detent 43 is provided to limit the downward movement of the slide member 36.

Figure 3:
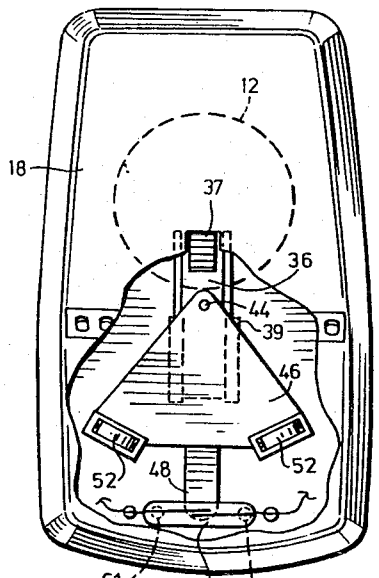

The slide member 36 has a central aperture 43 in which loosely engages a pin 44 which is integral with or affixed to a triangularly shaped pivotal member 46 having a central downwardly extending tab 48, the purpose of which will be explained subsequently. The pin 44 is at one apex of the triangularly shaped pivotal member 46, and at the other two vertices are located receptors 50 for disc magnets 52. As can be seen in FIGS. 1 and 3, the disc magnets 52 are angled with respect to each other.

Located at the bottom of the central mounting plate 15 are two integral posts 54 which are spaced apart laterally, and which support between them a magnetic reed switch 56 of known type. The magnetic reed switch is a "normally open" type, and closes only upon the presence of a sufficient concentration of magnetic flux lines running in the appropriate direction.

Figure 5:
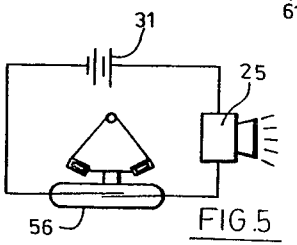
FIG. 5 is a circuit diagram for the alarm of FIG. 1.

The magnetic reed switch 56 is connected in the circuit of FIG. 5, which is a loop circuit joining the sound-producing alarm 25 with the battery 31. The sound-producing alarm 25 is triggered only when the reeds of the magnetic reed switch 56 close.

The operation of this alarm will now be described.

FIG. 3 shows the alarm in the "disarmed" position. In this position, the slide member 36 is raised, along with the pivotal member 46, which in turn removes the magnets 52 far enough away from the magnetic reed switch 56 that the latter is unaffected by the magnets 52, regardless of the angular orientation of the alarm. Thus, with the various components in the condition shown in FIG. 3, and with the alarm affixed to a door handle, the rotation of the door handle would not cause the alarm to sound.

Figure 4:
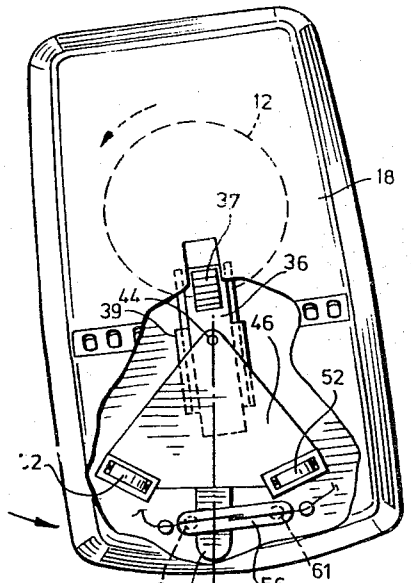
FIGS. 3 and 4 show the essential working components of the alarm in the "at rest" position and the "sounding" position respectively.

FIG. 4 shows a setting in which the slide member 36 has been lowered in order to bring the pivotal member 46 and the magnets 52 into closer proximity with the magnetic reed switch 56. In this position, referred to as the "juxtaposed position" in the appended claims (as opposed to the "separated position" of FIG. 3), the magnetic reed switch 56 would be unaffected by either magnet 52 when the pivotal member 46 is hanging in its equilibrium orientation (i.e. symmetrical as is shown in FIG. 3), but would be closed by one or other of the two magnets 52 when the pivotal member 46 swings through a given displacement from the equilibrium orientation, as would take place upon the rotation of the door handle 12 to which the alarm is affixed.

The reason why the reeds of the magnetic reed switch 56 close upon a sufficient concentration of magnetic flux lines in the appropriate direction, is that the reeds themselves are of ferromagnetic material and in the presence of a magnetic field properly oriented, the reeds become temporary magnetics. The ends of the reeds overlap slightly, and these ends temporarily become north and south poles of the temporary magnets. As such, they attract each other and when contact occurs, the electrical connection is made.

Due to a phenomenon called "residual magnetism" in all ferromagnetic materials, it is a fact that once the reeds of the magnetic reed switch 56 have come together into contact, the reeds will maintain this contact even though the magnetic flux line density drops down to a level below that at which the original contact took place. This is a well-recognized characteristic of magnetic reed switches, and it is this characteristic which is being utilized to advantage in the present device.

Thus, the return of the pivotal member 46 to an equilibrium position (in which it is symmetrical about the centre line of the alarm) will return the magnets to the position they held before the pivoting, at a time when the flux lines were insufficient to cause the magnetic reed switch to close, but even though the magnets return to this original position, the fact that the magnetic reed switch has closed in the meantime will mean that it will remain closed. Until the magnets 52 are removed a considerable distance away from the magnetic reed switch, as by returning the pivotal member to the position shown in FIG. 3, the magnetic reed switch 56 will stay closed, and the alarm will continue to sound.

It is thus impossible for a would-be thief to stop the alarm sound simply by turning the handle back to its original "at rest" position, and the continuous sounding of the alarm will ensure that even the deepest sleeper will be aroused, so that the police or other authorities may be summoned.

The operator will be able to ascertain the correct position for the slide 36 merely by trial-and-error, and when this position is located, it can be marked on the outside surface of the housing adjacent the protruding finger button 37 of the slide 36.

As can be seen in the figures, the tab 48, regardless of the vertical position of the slide 36, is entrapped between two short cylindrical protrusions 61 which limit the arc through which the pivotal member 46 can swing. This is important, because if the pivotal member 46 were allowed to swing so far that one of the magnets 52 were exactly centred over the magnetic reed switch 56, the reeds would automatically open due to the fact that the flux lines are running perpendicular to the direction of the reeds, and this would arrest the alarm.

The front housing 18 has apertures 63 to allow the sound made by the device 25 to emanate from the alarm.

In FIG. 1 a battery clip 66 is shown, in separated position from the terminals 67 of the battery 31, and it is to be understood that, for operation, the battery clip 66 would be attached to the terminals 67.

Figure 6:
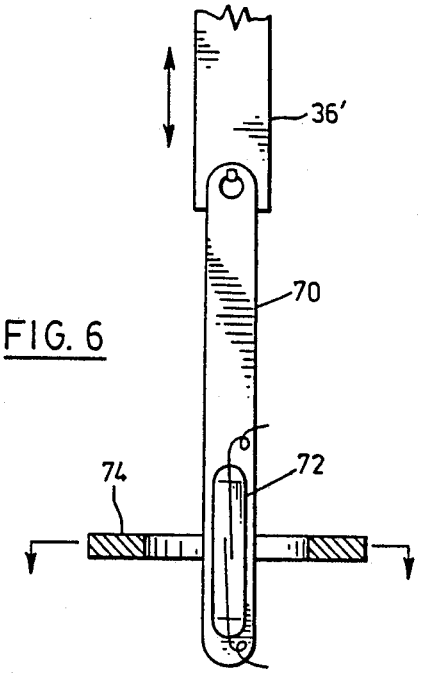
FIGS. 6 and 7 are elevational and cross-sectional views, respectively, of a second embodiment of this invention.
Figure 7:
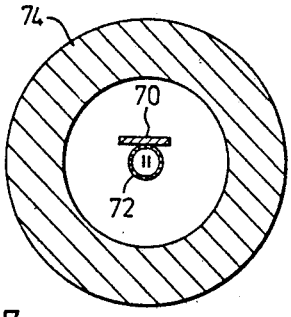

Attention is now directed to FIGS. 6 and 7, illustrating the second embodiment of this invention.

In FIG. 6, a slide member 36' is shown, which is analogous to the slide member 36 shown in FIG. 1, and is adapted to reciprocate vertically in a guide way (not shown). Pivoted to the slide member 36' is a link member 70, to the lower end of which is affixed a magnetic reed switch 72, the latter being in a vertical orientation when the link member 70 is vertical. The nature of the pivotal connection between the link member 70 and the slide member 36' is such as to allow the link member to swing in any direction from its vertical position, i.e. not only swinging movement in the plane of the drawing paper in FIG. 6, but also movement directions at angles to the plane of the paper. A circular or annular magnet 74 is provided, the same being seen in section in FIG. 6. The circular magnet 74 is fixed with respect to the main frame or housing of the device (not shown), which can be taken to be analogous to that shown for the first embodiment of this invention. It is known that, for circular magnets of the kind shown, the flux lines leave and enter the annulus of the magnet in a direction parallel to its centre axis, i.e. vertically in the orientation shown in FIG. 6. It is also known that the flux lines have greater concentration close to the annulus, and that the flux line concentration is relatively weak in the axial centre of the magnet.

The strength of the circular magnet 74 is selected such that, when the magnetic reed switch 72 is located at and aligned with the axis of the circular magnet 74, the flux line concentration will not be strong enough to close the reeds of the magnetic reed switch. However, as soon as the reed switch moves close to the magnetic annulus itself, regardless of the direction in which the movement takes place, the flux line concentration will increase sufficiently to close the reeds of the magnetic reed switch. Further, once the reeds of the magnetic reed switch 72 have closed and thus formed a "magnetic circuit", the return of the magnetic reed switch 72 to the axial centre of the circular magnet 74 will not act to open the reeds, since the magnetic flux line concentration in the centre of the circular magnet 74, although not strong enough to close the reeds initially, is sufficiently strong the maintain the reeds in the closed position once they have been previously closed (by movement in the direction of the annulus and away from the centre axis).

To reset the burglar alarm in accordance with the second embodiment of this invention, the procedure is the same as with the first embodiment, namely to raise the magnetic reed switch 72 upwardly away from or "out of" the circular magnet 74, by moving the slide member 36' upwardly. This will allow the reeds of the magnetic reed switch 72 to open, whereupon the slide member 36' may be lowered again, to bring the magnetic reed switch 72 back to the position shown in FIG. 6. Since the reeds are open upon this descent, they will not close due to the fact that the magnetic flux line concentration at the axial centre of the circular magnet 74 is not strong enough to accomplish this.

The particular advantage of the second embodiment of this invention relates to the fact that movement of the burglar alarm housing in a translational sense in any direction will cause the reeds of the magnetic reed switch 72 to close, thus sounding the alarm. It is assumed here that the movement involves sufficient acceleration to cause the link member 72 to "lag" behind the main body of the burglar alarm housing, thus causing it to swing its lower end over toward one portion of the annulus of the circular magnet 74. Likewise, rotation of the burglar alarm away from its vertical position, for example when it falls over or when it is rotated while being affixed to a door handle, will also cause the alarm to sound, for reasons explained above.

I claim:

1. An alarm comprising:

a mounting base, means for affixing the mounting base to an item whose movement is to be signalled by the alarm, a magnetic reed switch constituting a first element, a magnet constituting a second element, one of said elements being mounted on a pivotal member capable of pivoting with respect to the mounting base, the other of said elements being capable of retaining a given position with respect to the mounting base, means for adjusting the relative distance from the pivot location for the pivotal member to the location of said other of said elements, between a separated position in which the reed switch is unaffected by the magnet regardless of pivotal movement of the pivotal member, and a juxtaposed position in which the reed switch is (a) unaffected by the magnet when the pivotal member hangs initially in an equilibrium position, (b) closed by the magnet when the pivotal member swings through a given displacement from said equilibrium position, and (c) remains closed after the pivotal member swings back to said equilibrium position, an electrically-powered signal-creating device, and an electrical circuit by which power from a power souce is supplied by way of said reed switch to said signal-creating device.

2. The invention claimed in claim 1, in which the magnet is mounted on the pivotal member, the latter being pivoted to a slide member which can be adjusted toward and away from the magnetic reed switch, which latter is fixedly mounted to the mounting base, the slide member constituting said means for adjusting.

3. The invention claimed in claim 2, in which there are two magnets mounted on the pivotal member in triangular relationship with the pivot location, the magnets lying adjacently above but outboard of the ends of the magnetic reed switch when the pivotal member hangs initially in an equilibrium position.

4. The invention claimed in claim 1, claim 2 or claim 3, in which the signal-creating device is a sound alarm.

5. The invention claimed in claim 1, claim 2 or claim 3, in which said means for affixing is constituted by a resilient gripping cavity into which a doorknob can be forcefully inserted and gripped.

6. The invention claimed in claim 1, claim 2 or claim 3, in which the power source is a dry cell battery and the signal-creating device is a sound-generating alarm, and in which the circuit is a closed loop linking the battery, the sound-generating alarm and the magnetic reed switch.

7. The invention claimed in claim 1, in which the magnet is an annular magnet fixed with respect to the mounting base, and in which the magnetic reed switch is mounted on said pivotal member capable of pivoting with respect to the mounting base, the pivoting of the pivotal member being possible in any direction.

* * * * *